US005459951A

United States Patent [19]

McCray et al.

[11] Patent Number: 5,459,951

[45] Date of Patent: Oct. 24, 1995

[54] BALLAST SHOULDER CLEANER

[75] Inventors: Philip C. McCray, Wetumpka; Steven L. Atchison, Montgomery, both of Ala.

[73] Assignee: Knox Kershaw, Inc., Montgomery, Ala.

[21] Appl. No.: 130,775

[22] Filed: Oct. 4, 1993

[51] Int. Cl.[6] ..... E02F 5/22

[52] U.S. Cl. ..... 37/105; 37/207; 171/16; 172/30

[58] Field of Search ..... 37/104, 105, 106, 37/198, 207, 107, 235; 171/16; 172/30, 110, 111, 784, 189, 786, 787, 794, 816, 264, 265; 15/78; 104/279

[56] References Cited

U.S. PATENT DOCUMENTS

| | | | |
|---|---|---|---|
| 1,546,071 | 7/1925 | Harris | 15/87 |
| 2,268,519 | 12/1941 | Teager | 15/78 |
| 2,936,537 | 5/1960 | Bain | 37/233 |
| 3,019,536 | 2/1962 | Kershaw | 37/104 |
| 3,204,352 | 9/1965 | Hughes | 37/235 X |
| 3,612,184 | 10/1971 | Plasser | 171/16 |
| 3,706,145 | 12/1972 | Bucksch et al. | 37/105 |
| 4,096,652 | 6/1978 | Raines et al. | 37/105 X |
| 4,707,935 | 11/1987 | Cicin-Sain | 37/105 |
| 4,835,887 | 6/1989 | Theurer | 37/104 |
| 5,097,608 | 3/1992 | Theurer | 37/104 |

*Primary Examiner*—Randolph A. Reese
*Assistant Examiner*—Victor Batson
*Attorney, Agent, or Firm*—C. A. Phillips

[57] ABSTRACT

A ballast machine for plowing ballast from the outer ends of rail supporting cross ties of a railroad bed. A ballast tie plow assembly is mounted to the frame of the ballast machine for vertical movement thereon. The tie plow assembly includes ballast engaging blades which are disposed for biased, pivotal movement responsive to engagement of the blades with an obstruction on the railroad bed or cross ties. Means are provided for vertical positioning of the tie plow assembly.

12 Claims, 10 Drawing Sheets

BALLAST SHOULDER CLEANER

FIELD OF THE INVENTION

This invention is directed generally to ballast regulating machines movable along rails on a railroad bed and particularly to ballast regulating machines having resiliently mounted tie plows for engaging and "plowing" ballast from the outside upper surfaces of the cross ties of the railroad bed.

BACKGROUND OF THE INVENTION

It is well known to provide ballast regulating machines to regulate the distribution and shaping of ballast on a railroad track bed. Typically, the machines include plows to distribute the ballast between two track rails which are fastened to cross ties as the machine moves along the tracks. Tie plows which distribute the ballast on the field side (ends of the cross ties which extend outside and away from the tracks) are also known. Such tie plows may consist of a rigidly mounted blade assembly having a blade which is lowered to a position atop the ends of the cross ties and which engages the upper surfaces of the cross ties as the machine moves along the track. It can be readily seen that if the upper surfaces of the cross ties are not substantially coplanar or if the ties have an upwardly projecting element on its upper surface, the blade is subjected to breaking or bending in response to it striking the uneven surface. Such bending or breaking of the blades require considerable "down time" in order to repair and/or replace damaged blades. Such a replacement is costly both from a standpoint of blade cost plus the cost of the "down time."

Some U.S. patents relating to apparatus for distributing ballast across a railroad bed are as follows: U.S. Pat. No. 3,612,184, issued Oct. 12, 1971, to Franz Plasser et al.; U.S. Pat. No. 4,249,325, issued Feb. 10, 1981, to Josef Theurer; U.S. Pat. No. 4,266,351, issued May 12, 1981, to Emmett W. Cox; U.S. Pat. No. 4,425,969, issued Jan. 17, 1989, to Rolando Naggar; U.S. Pat. No. 4,835,887, issued Jun. 6, 1989, to Josef Theurer; U.S. Pat. No. 5,052,133, issued Oct. 1, 1991, to Pierre Mohr; and U.S. Pat. No. 5,097,608, issued Mar. 24, 1992, to Josef Theurer.

Apparatus of the present invention includes a pair of oppositely disposed spring-loaded tie plow assemblies, each assembly being disposed for mounting on opposite sides of a ballast shoulder cleaner which is movable along a railroad track. Each assembly includes a support plate mounted to a positioning mechanism which raises and lowers the assembly. A pair of spring-loaded blades depend from the bottom of the support plate and are arranged in vertically staggered relation (one is longer than the other). The blades plow the ballast off the top of the cross ties, and the spring loading allows them to flex clear of any obstruction they may hit. The blades are mounted at an angle to the rails so that they plow the ballast away from the rail. Attached to the spring-loaded tie plow frame and directly behind the second blade is a double row of sweeper elements to drag the loose rock off the ties.

A ballast broom mechanism follows the tie plow to further aid in "dressing" the ballast bed. The ballast broom mechanism cleans any remaining ballast from the top of the ties and from around the field side of the rail area. The ballast broom mechanism includes a first broom assembly which is mounted on a horizontal shaft and rotatable to sweep the top of the ties outside the rail. The "horizontally mounted" broom assembly utilizes a spiral reel having the sweeping elements attached thereto for sweeping the ballast to the outside of the track shoulder. The second broom assembly is mounted to a vertical shaft. This "vertical shaft broom assembly" sweeps along the outside of the rail base, cleaning the rail base and the tie plate area. As this vertical shaft rotates, it discharges some of its rocks forward into the first broom assembly (horizontal shaft broom assembly), which sweeps them to the outside. Other rocks are carried directly to the track shoulder by the vertical broom assembly.

It is, therefore, an object of the present invention to provide a ballast "dressing" apparatus which distributes and dresses ballast on a railroad track bed on the outside of the rails.

It is another object of the present invention to provide such a ballast dressing apparatus with tie plow means for directing the ballast away from the outside of the rails, such tie plow means including blades which are capable of being flexed to prevent damage thereto in response to striking an obstruction on the ballast bed or ties.

It is a further object of the present invention to provide such a ballast dressing device with further ballast dressing means in the form of rotating broom means which sweeps remaining ballast off the upper surfaces of the ties and also from beneath the upper flanged wheel engaging surface of the rails.

It is yet another object of the present invention to provide such rotating broom means with a pair of orthogonally rotating assemblies which cooperate to sweep ballast from the top of the ends of the cross ties.

These and other objects of the present invention will become more readily apparent from an understanding of the following drawings and description.

DESCRIPTION OF THE PREFERRED EMBODIMENT

Figure 1:
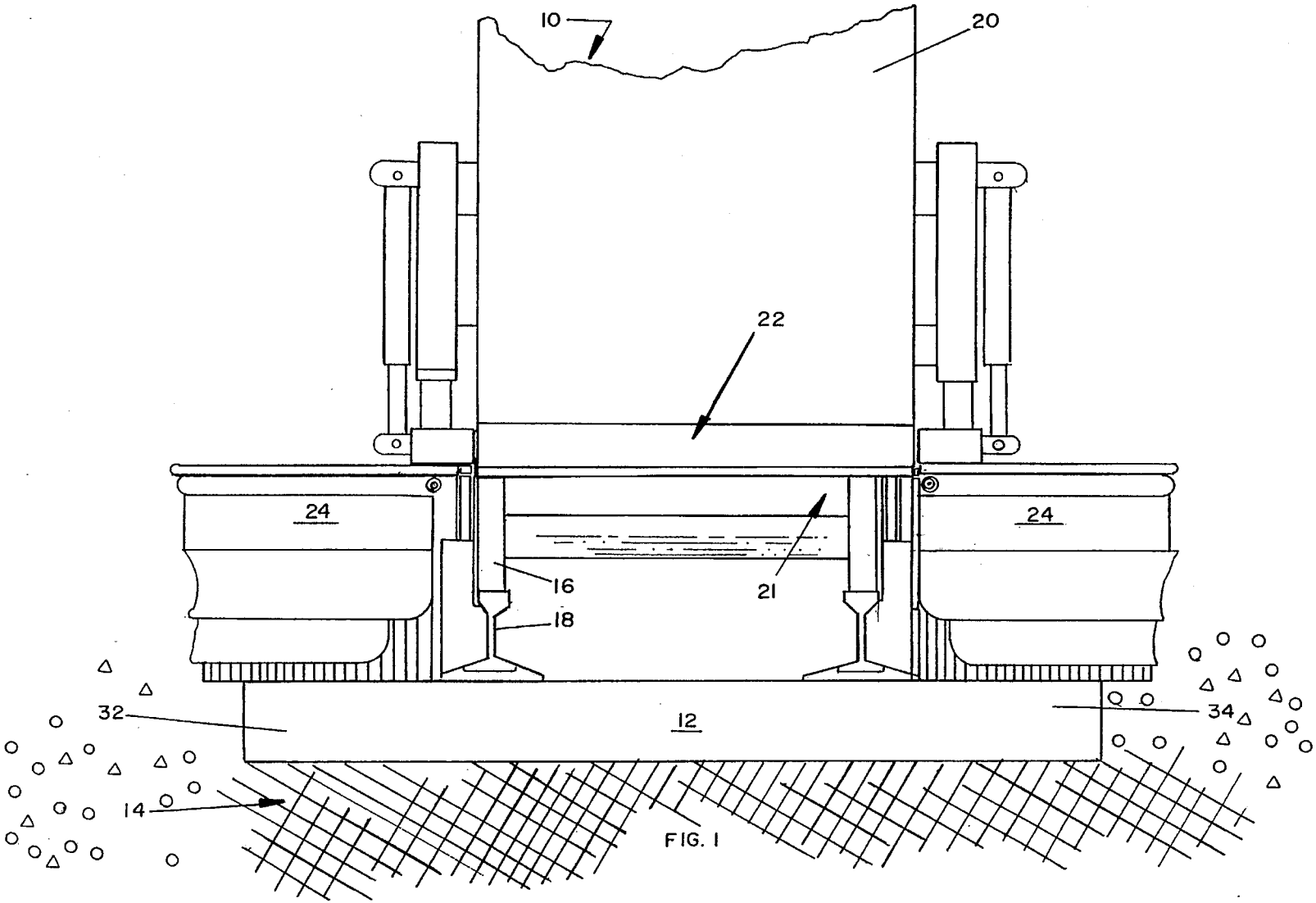
FIG. 1 is a front elevational view of a ballast shoulder cleaner machine illustrating the tie plows of the present invention mounted on opposite sides thereof.

A track working machine 10 for removing the ballast from the ends of cross ties 12 mounted on a railroad track bed 14 is illustrated in FIG. 1, which is a front elevational view of machine 10, known as a ballast shoulder cleaner. The machine 10 is supported on track engaging wheels 16 which support machine 10 for movement along rails 18. The machine 10 includes an upper portion 20, a lower portion 21, and a main frame 22. The machine may be self-propelling, if desired, or may be non-self-propelling, in which case it would be hooked (connected) to a separate driving machine which would provide the propelling force for the non-self-propelling track working machine (ballast shoulder cleaner) 10. In either case, the various components which engage and remove the ballast from the ends of the cross ties are connected to a fluidic actuating system which supplies fluid pressure to the various components for actuation of the components to control the positioning thereof relative to the track bed and cross ties.

Figure 2:
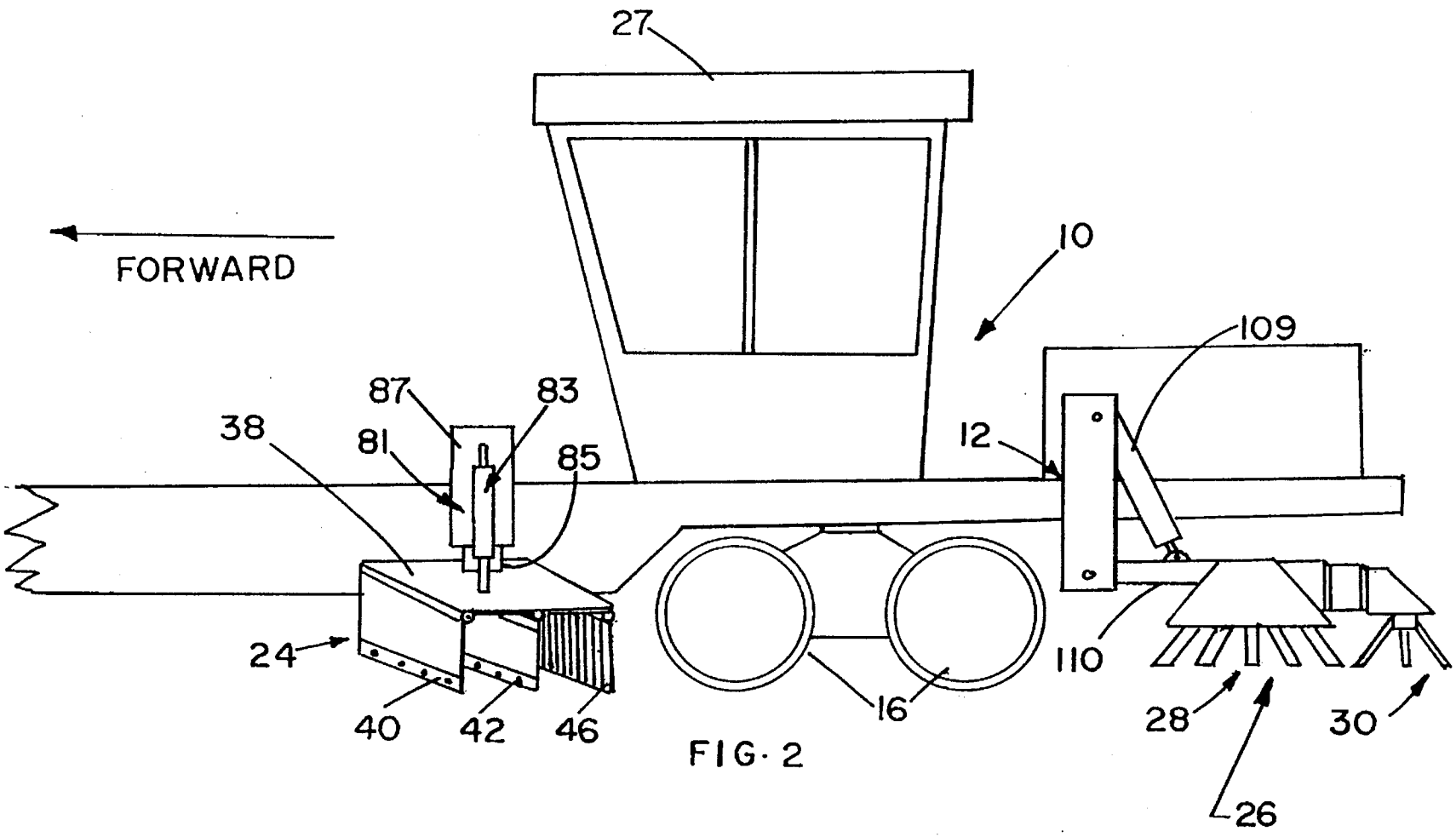
FIG. 2 is a side elevational view of the ballast shoulder cleaner machine of FIG. 1 and further illustrates the relative positions of the tie plows and ballast sweeper mechanism for "dressing" the ballast on the railroad bed.

Such components may include a pair of tie plow assemblies 24 which are shown on opposite sides of machine 10 in FIG. 1 (which is a front elevational view) and sweeper mechanisms 26 which are likewise provided on opposite sides of machine 10, but only one side is shown in FIG. 2 (which is a side elevational view). Each sweeper mechanism 26 is comprised of first and second serially arranged adjacent broom assemblies 28 and 30. FIG. 2 further illustrates machine 10 as having a cab 27 to enclose an operator and the control panel for operating various components of machine 10.

Broom assembly 28 is mounted on a horizontally mounted shaft, and broom assembly 30 is mounted on a vertical shaft, and the broom assemblies cooperate to distribute the ballast along the track bed as described hereinbelow. The tie plow assembly 24 and ballast sweeping mechanism 26 cooperate to properly "dress" the ballast relative to the ends of the cross ties 12 and track bed 14.

FIG. 1 is a partial front elevational view of the shoulder cleaning machine 10 and illustrates a pair of tie plow assemblies 24, each respectively mounted on opposite sides of machine 10. Tie plow assemblies 24 are identical. As can be seen in FIG. 1, each tie plow is extended to cover the outside ends 32 and 34 of the cross ties 12. The tie plow assemblies are capable of being raised and lowered as will be described hereinbelow.

Figure 3:
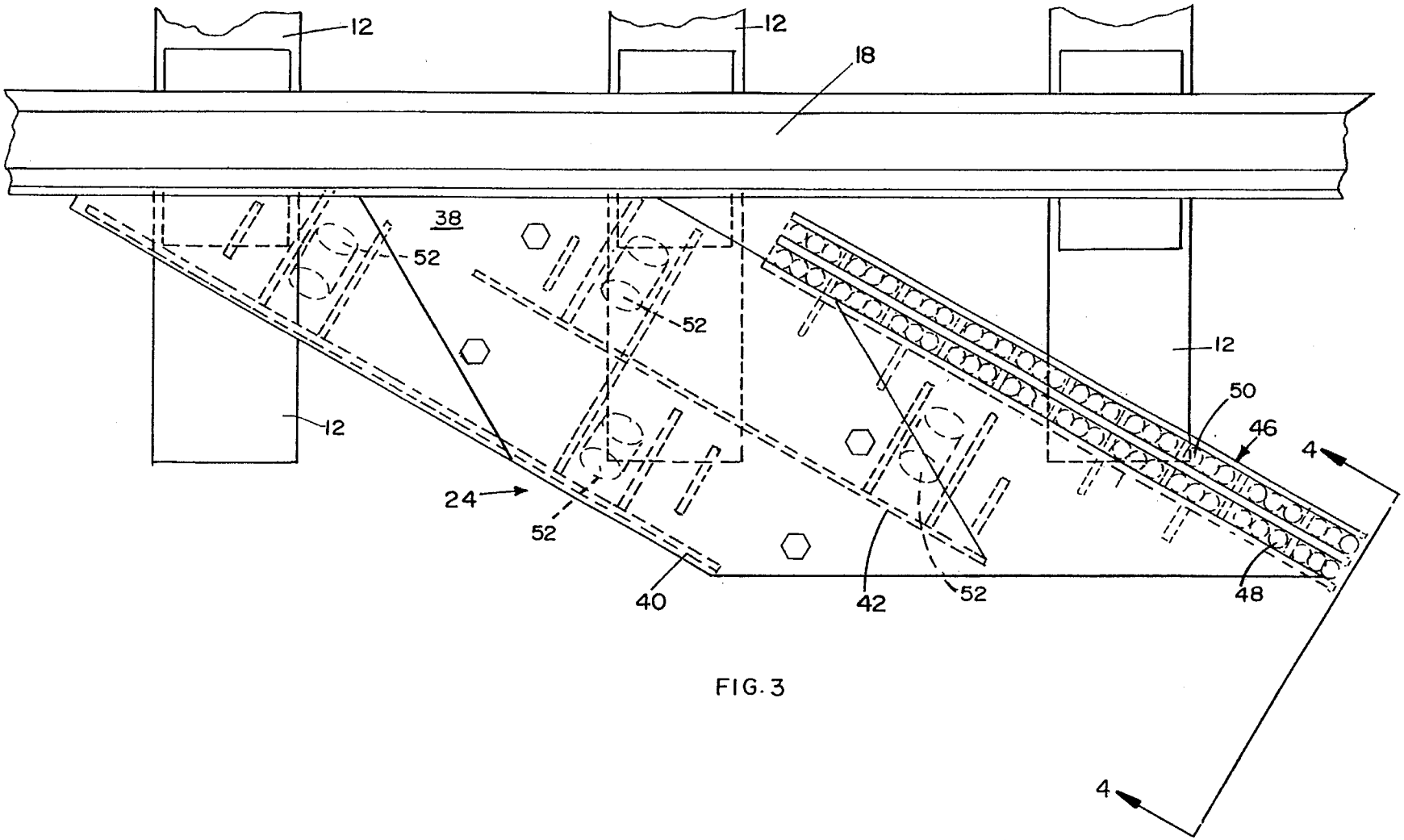
FIG. 3 is a plan view of the tie plow assembly of FIG. 1 superimposed over the ends of a plurality of railroad ties to illustrate the relative operational positions of the tie plow, track, and railroad tie ends.
Figure 4:
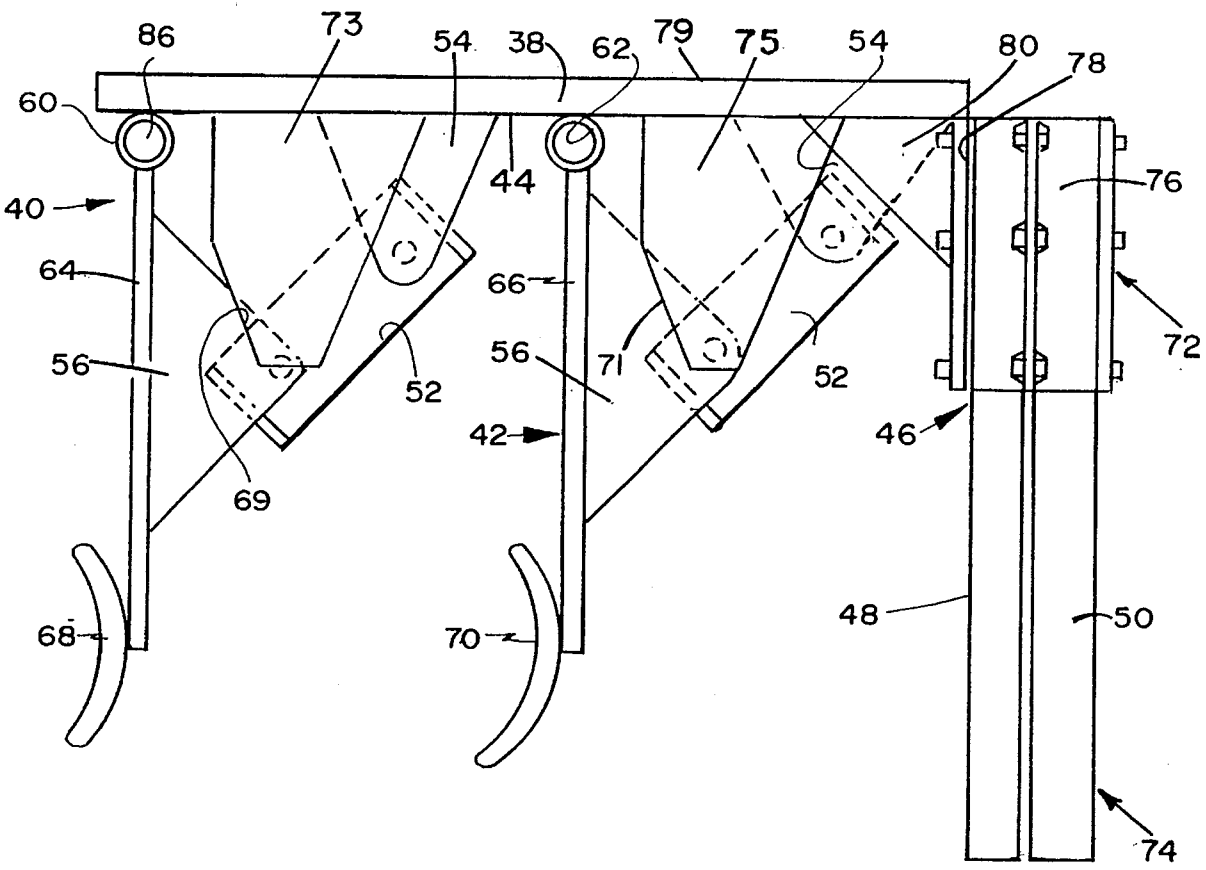
FIG. 4 is a view taken along line 4—4 of FIG. 3.

FIG. 3 is a plan view illustrating the tie plow assembly (identified by the numeral 24) of the present invention in relation to the cross ties 12 and rail 18. As shown in FIG. 3, an upper support plate 38 is shown to support blade assemblies 40 and 42 which depend from the lower surface 44 of plate 38 (FIG. 4). A broom mechanism 46 is mounted to the rear of blade assemblies 40 and 42 and is comprised of a double row of broom elements 48 and 50 (FIGS. 3 and 4) which also extend beneath the lower surface 44 of plate 38. A plurality of compression coil spring assemblies 52 are provided to provide a resilient mounting for blade assemblies 40 and 42. Such mounting permits blade movement responsive to the blade striking an obstruction. The coil springs are supported between respective ones of a first plurality of gussets 54 (FIG. 4) secured to and depending from lower surface 44 of plate 38 and respective ones of a second plurality of gussets 56 secured to blade assemblies 40 and 42.

FIG. 4 is a view along line 4—4 of FIG. 3 and illustrates an end view of the blade and broom elements of FIG. 3. As seen in FIG. 4, each of the blade assemblies 40 (forward blade assembly) and 42 (rear blade assembly) is pivotally secured to the lower surface 44 of plate 38 by hinge assemblies 60 and 62. Blade assemblies 40 and 42 include flat plates 64 and 66 which extend downwardly from each hinge and is provided with removable arcuate blades 68 and 70 which are removably secured to the distal ends of the plates 64 and 66. The rear blade 70 extends further down than the forward blade 68. As can be seen in FIG. 4, the gussets 54 which are secured to the lower surface 44 of plate 38 pivotally support one end of a coil spring assembly 52, and the gussets 56 which are secured to the plates 64 and 66 support the second end of the coil spring assembly 52. The coil springs permit the blade assemblies to be resiliently mounted so that the blades may flex and not be broken if they should strike a rigid object on the cross ties. Each blade assembly has an associated stop member 69 and 71 which limits the movement of the associated blade assembly. As seen in FIG. 4, the stop members are formed on gussets 73 and 75 which are secured to and depend from lower surface 44 of plate 38.

The broom elements 48 and 50 are formed of rubber coated flexible wire cables and include upper and lower ends 72 and 74. Upper end 72 is secured in a housing 76 which is secured to a plate 78, which is secured to support plate 38 and depends therefrom. A gusset 80 serves as a support for plate 78. A slider box assembly 81 (FIGS. 2 and 5) is secured to the upper surface 79 of plate 38 and to the side of the machine frame 12. The slider box assembly 81 includes an inner box 85 slidably mounted in an outer box 87 and a hydraulically controlled piston, piston cylinder, and piston rod assembly 83 which raises and lowers each of the plow assemblies. One end of the cylinder is secured to the outer box, and one end of the piston is secured to the inner box which is rigidly secured to the upper surface of the tie plow assembly. Actuation of the hydraulic piston for raising and lowering of the plow assemblies is controlled by an operator in the cab through a control console and is described hereinbelow.

Figure 5:
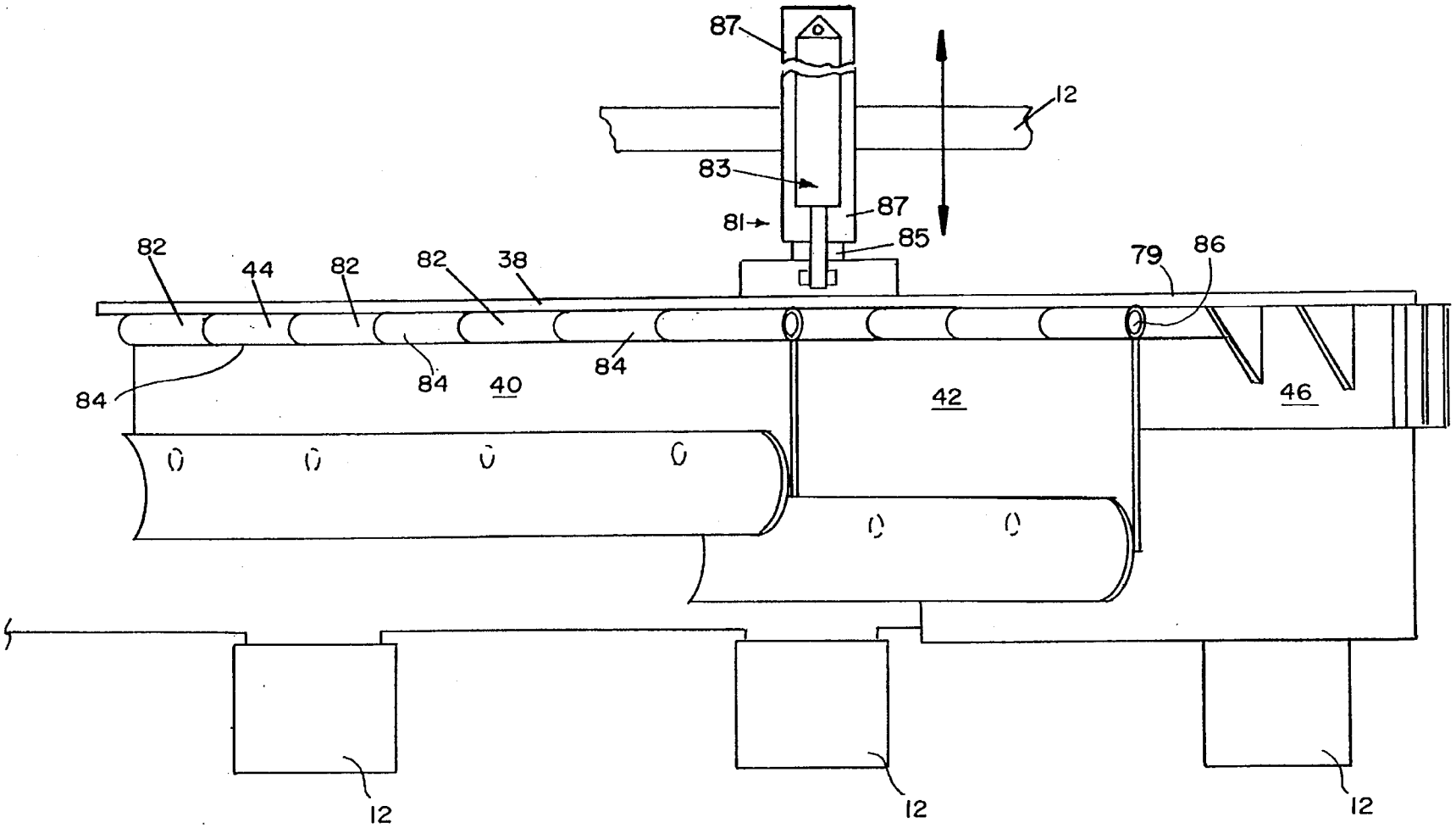
FIG. 5 is a side elevational view of a tie plow shown in FIGS. 1 and 3. A slider box is shown attached to the frame of the machine and to the top of the tie plow assembly for raising and lowering thereof.

FIG. 5 is a side elevational view of the tie plow assembly. As seen in FIG. 5, the hinge assemblies for pivotally securing the tie plow blades to the support plate 38 includes a first plurality of spaced cylindrical members 82 which are rigidly secured to the lower surface 44 of plate 38 and a second plurality of spaced cylindrical members 84 which are rigidly secured to the plates of each blade assembly. These cylindrical members are mated in aligned, staggered relation and held together by a rod 86 which extends substantially the length of the blade assemblies to form a hinge.

As seen in FIGS. 1 and 5 and described above, the plow assemblies are raised and lowered by the slider box mechanism 81. However, if desired, the tie plow assemblies are raised and lowered by means of a four-bar parallel linkage arrangement (described hereinbelow). This linkage keeps each plow level (front to rear) as they are raised/lowered.

The plow blades (left and right) are bolted to the center hinge weldment. This allows quick blade replacement without disassembling the center pivot shaft/hinge assembly.

Figure 6:
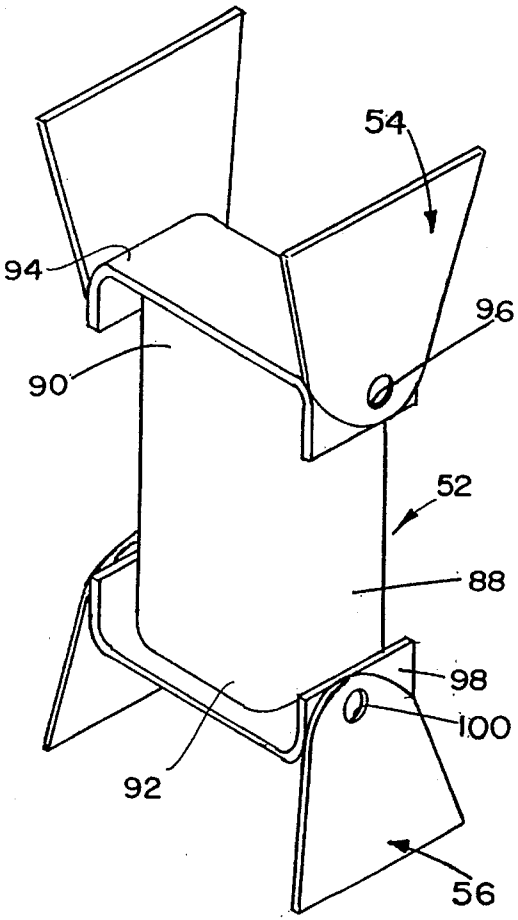
FIG. 6 is a diagrammatic pictorial view of the spring assembly as used in the plow assembly of the present invention.

FIG. 6 is a pictorial view of the coil spring mounting arrangement. As seen in FIG. 6, the coil spring assemblies 52 include a coil spring 88 having ends 90 and 92. End 90 is shown to be secured to a U-shaped bracket 94 which is pivotally mounted to a shaft 96 which is adapted to be secured to gusset 54. The second end 92 of the coil spring 88 is secured to a bracket 98 which is pivotally mounted to a shaft 100 which is adapted to be secured to gusset 56.

Figure 7:
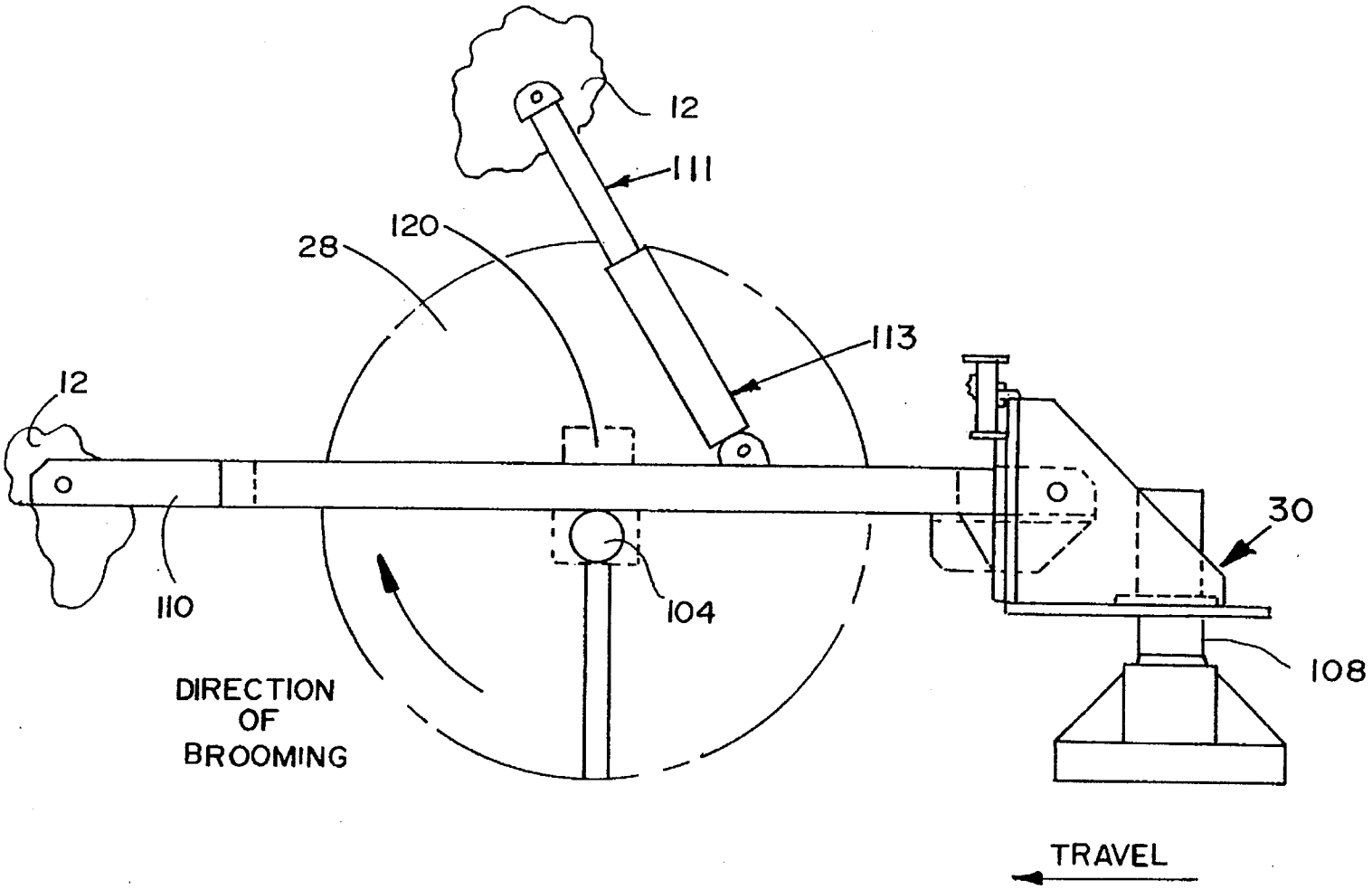
FIG. 7 is a side elevational view of the sweeper mechanism shown in FIG. 2 illustrating the horizontally mounted and vertically mounted broom assemblies.

FIG. 7 is a side elevational view of the ballast sweeper mechanism 26 which is shown to include first broom assembly 28 which is mounted on a horizontal shaft 104 and second broom assembly 30 which is mounted on a vertically disposed shaft 108. A linkage member 110 is connected to the broom assemblies and is provided for raising and lowering the broom assemblies. The linkage member is pivotally connected to frame 12 of machine 10 and to the broom assemblies. The fluid actuator 109 for the broom assembly is shown to have the piston rod 111 thereof connected to frame 12 of the machine and the end of the cylinder 113 connected to linkage member 110 intermediate to the ends thereof.

Figure 8:
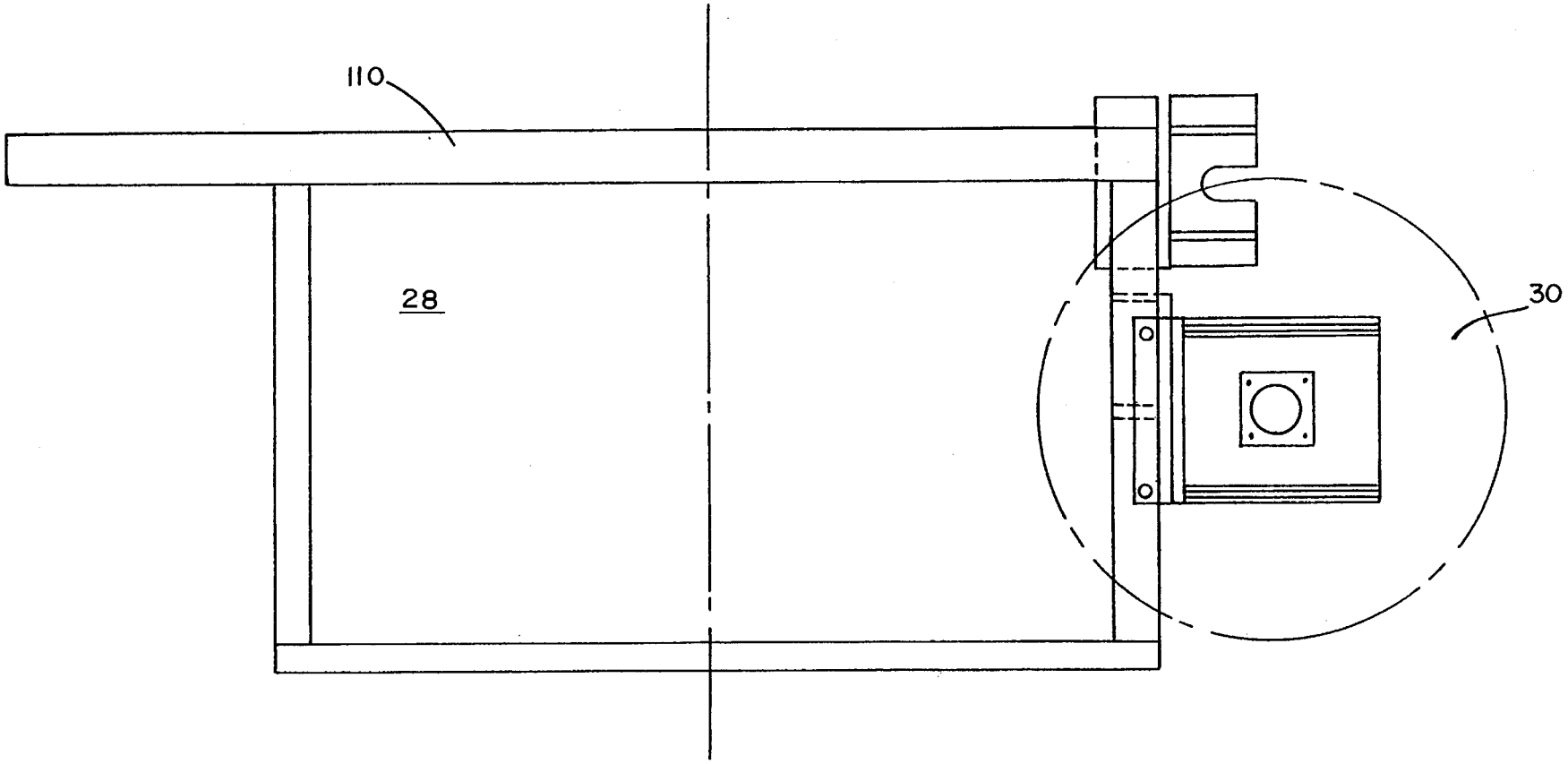
FIG. 8 is a plan view of the apparatus shown in FIG. 7.

FIG. 8 is a plan view of the broom assemblies of FIG. 7.

Figure 9:
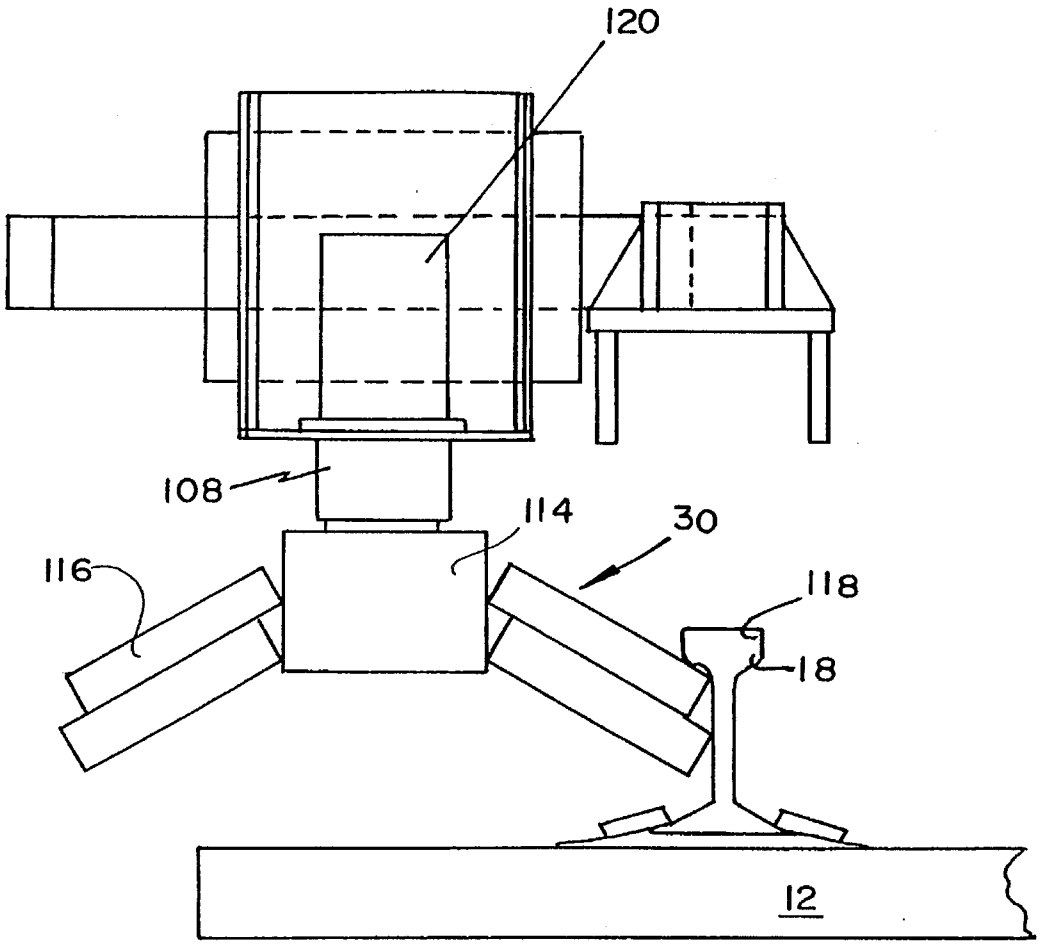
FIG. 9 is an end elevational view of the vertically mounted broom assembly of FIGS. 2 and 7. The view illustrates the broom elements in operational contact with the track and cross ties.

FIG. 9 is an end elevational view of the vertical broom assembly of FIGS. 2 and 7. As seen in FIG. 9, the vertical broom assembly incudes a reel 114 attached to shaft 108. A plurality of broom elements 116 extend angularly (downward) and radially from reel 114. The broom elements 116 are illustrated in FIG. 9 as reaching under the upper flanged portion 118 of rail 18 to remove ballast therefrom. A motor 120 is shown for rotating the reel. Likewise, a motor 120 is illustrated in FIG. 7 for operating the horizontal shaft (through appropriate gears) of broom assembly 28. These motors may be hydraulic (preferred) or electrical, as desired.

Figure 10:
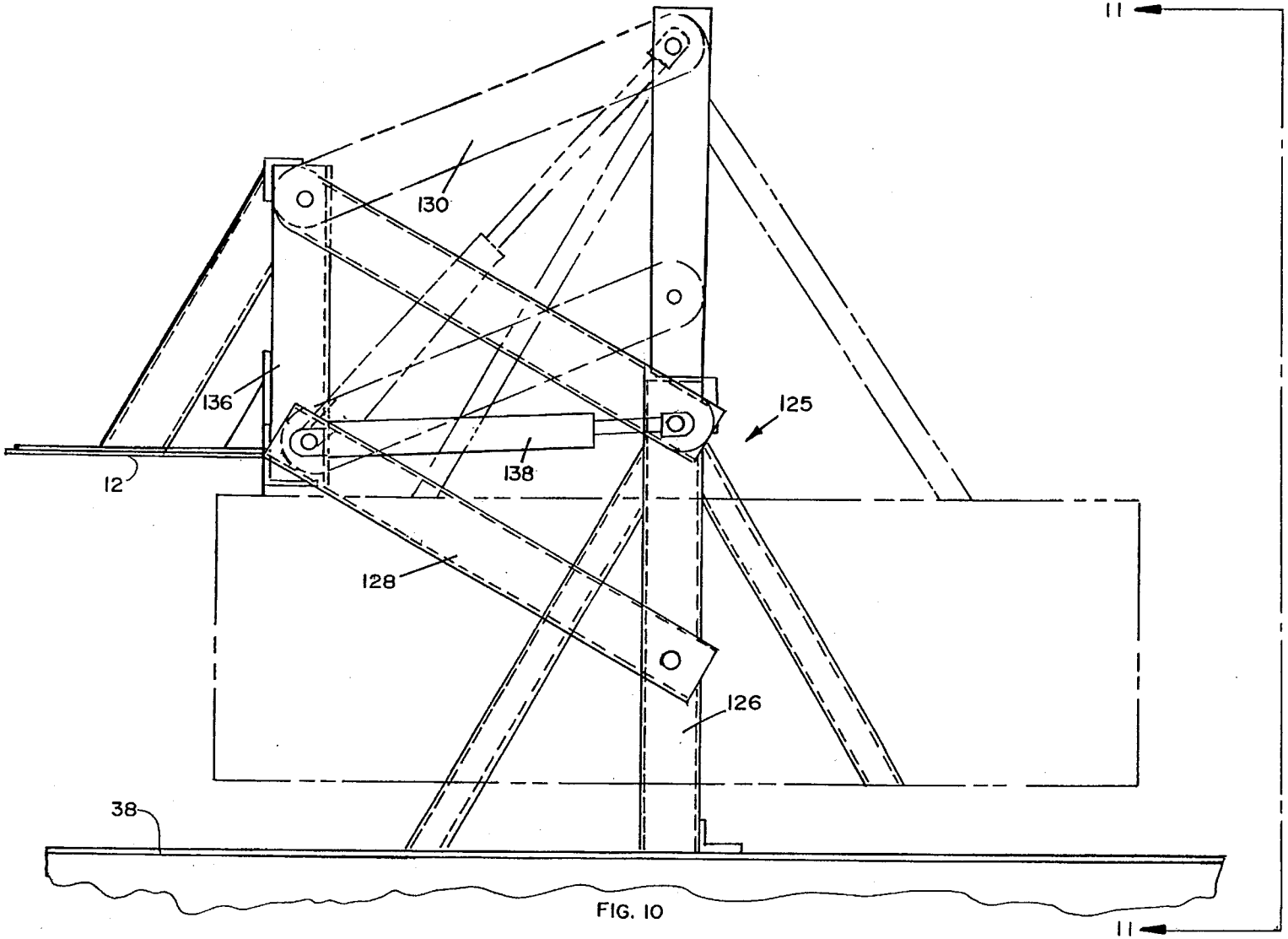
FIG. 10 is an elevational view illustrating a parallel four-bar arrangement and fluid actuator which may be used in raising and lowering the plow assembly and sweeper mechanism of the present invention.
Figure 11:
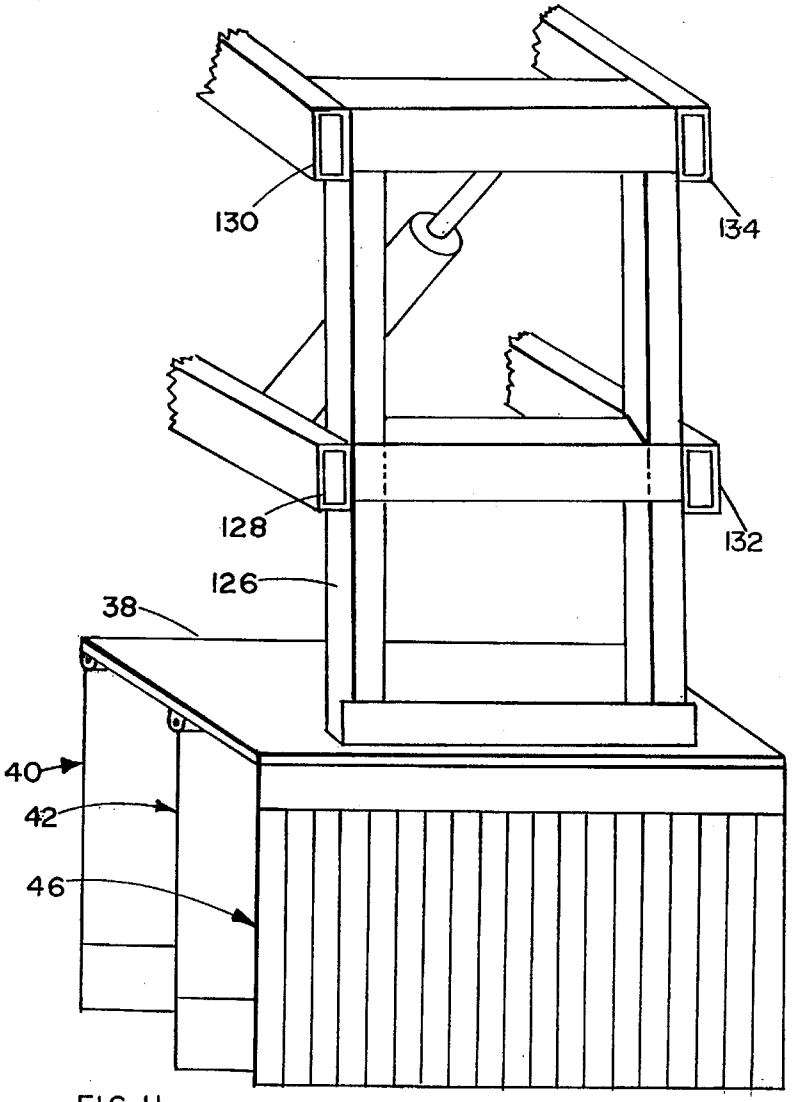
FIG. 11 is an elevational view taken along line 11—11 of FIG. 10.

FIGS. 10 and 11 illustrate a four-bar parallel linkage arrangement 125 which may be used for raising and lowering the plow and/or the broom assembly. As seen in FIGS. 10 and 11, the parallel bar arrangement includes a frame 126 having four parallel bars 128, 130, 132, and 134 secured thereto. The frame is connected to the upper surface of the support plate 38 of the tie plow. The parallel bars are pivotally connected to frame 126 and to a second frame 136 which is secured to frame 12 of machine 10. A fluid actuator 138 is connected between the two frames so that upon actuation, the piston is made to extend or retract to raise or lower the tie plow. It is to be understood that the parallel four-bar arrangement may be used in raising and lowering the broom assemblies as well as the tie plows.

Figure 12:
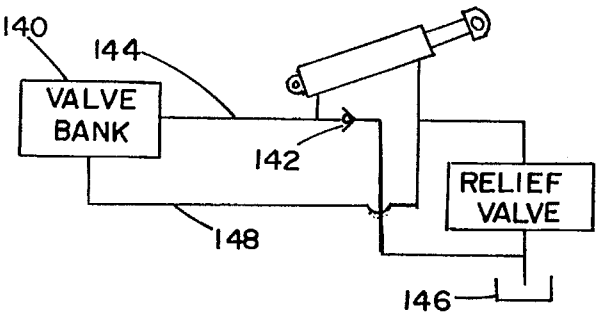
FIG. 12 is a diagrammatic view of a typical hydraulic circuit for operating any of the various fluid actuators of the present invention.

FIG. 12 is a diagrammatic view of a typical hydraulic system for actuating the various fluid actuators of the present invention which are used in raising and lowering the ballast dressing components. The hydraulic system is shown to include a valve bank 140 which routes the fluid to the desired actuator. A check valve 142 is shown mounted in a line 144 between the valve bank 140 and a fluid reservoir 146. A second line 148 connects the valve bank 140 directly to the cylinder of the actuator.

In operation, the ballast (reconditioned or new ballast) is placed on the track bed by a separate apparatus which also distributes the ballast from between the tracks to the outside of the tracks and onto the shoulders of the railroad bed. Apparatus of the present invention then removes excess ballast off of the tracks and the tops of the ends of the cross ties. This is accomplished by the blades of the tie plows which are positioned downwardly substantially in contact with the upper surfaces of the cross ties. As machine 10 is propelled along the track, the blades (which are in angular relation with the track) and the broom elements of the plow assembly move the ballast away from the rails and onto the outer edges of the bed shoulder. The separate mechanism which follows the tie plows sweep the remaining ballast off of the top of the cross ties and away from the rails. Broom assembly 30 (vertically mounted broom assembly) is tilted in angular relation to broom assembly 28 so that the broom elements can "sweep" the ballast away from the rail and from the surfaces of the cross ties directly into the broom assembly 28 (horizontally mounted broom assembly) where the rotary action of the broom elements propel the ballast outwardly from the rails and cross tie ends and onto the outer edges of the bed shoulder. A separate assembly (not part of this invention) then follows to "dress" the bed shoulders with the desired profile.

We claim:

1. A track working machine for dressing the ballast of a railroad bed having spaced rail supporting cross ties thereon, said cross ties including an upper surface and end portions extending away from the outside of the track, said machine including ballast dressing apparatus comprising:

a frame;

a ballast tie plow assembly vertically adjustably mounted on each side of said frame, each said ballast plow assembly including a support member having upper and lower surfaces and a blade assembly pivotally secured to and depending from said lower surface of said support member, said blade assembly including a plate secured to said lower surface of said support member, said plate having a blade secured thereto for engaging said ballast;

hinge means disposed between said blade assembly and said lower surface of said support plate to permit pivotal movement of said blade assembly responsive to impact of said blade with undesirable obstacles on said upper surface of said ties;

first sweeper means comprising a first boom assembly including a plurality of elongated sweeping elements rigidly mounted on and depending from said lower surface of said support member and in spaced adjacent relation with said blade assembly for sweeping across said upper surface of said ties subsequent to movement of said blade assemblies across said upper surface of said ties; and biasing means for permitting pivotal flexing movement of said blade assembly responsive to impact of said blade with said undesirable obstructions, said biasing means including a compression spring having a first end mounted on said blade assembly and a second end mounted on said lower surface of said support plate.

2. Apparatus as in claim 1 wherein said ballast plow assembly is comprised of first and second blade assemblies, each blade assembly including a said plate having a said blade secured thereto, said blade assemblies being disposed in spaced, forward and rear, relation, respectively, with said first blade assembly being shorter than said second blade assembly.

3. Apparatus as set forth in claim 2 wherein said ballast plow assemblies are mounted to said machine for angular relation with said rails.

4. Apparatus as set forth in claim 3 including second sweeper means mounted on said machine in spaced relation with said ballast plow assemblies, said second sweeper means disposed for sweeping remaining rock from said ties and said rail and comprising a horizontal shaft having sweeping elements extending radially therefrom, and motor means for rotating said shaft.

5. Apparatus as set forth in claim 4 including third sweeper means mounted on said machine in spaced relation with said second sweeper means, said third sweeper means including a vertical shaft having broom elements radially extending in angular relation therefrom, and motor means for rotating said vertical shaft.

6. Apparatus as set forth in claim 5 including means for providing vertical movement to said ballast sweeper mechanisms whereby said ballast sweeper mechanisms are movable to positions adjacent to and spaced from said upper surfaces of said ties.

7. Apparatus as set forth in claim 6 wherein said means for providing vertical movement to said ballast sweeper mechanism is a slider box assembly, said slider box assembly having an inner shaft mounted for slidable movement in a hollow outer shaft, said inner shaft being secured to said ballast sweeper mechanism and said outer shaft being secured to said ballast machine, and fluid actuator means including a cylinder, piston, and piston rod, said cylinder being secured to said outer hollow shaft and said piston rod being connected to said support plate of said ballast sweeper mechanism.

8. Apparatus as set forth in claim 6 wherein means for providing vertical movement to said ballast sweeper mechanism include a four-bar parallel linkage assembly, said linkage assembly comprising a first frame connected to said ballast sweeper mechanism and a second frame connected to said machine, said first and second frames being pivotally connected together by first and second pairs of parallel linkage members, each of said linkage member having distal ends which are respectively pivotally secured to said first and second frames, and fluid actuator means disposed for relative pivotal movement of said first and second frames whereby said ballast sweeper mechanism is raised or lowered.

9. Apparatus as set forth in claim 2 wherein said biasing means is a compression spring having a first end mounted on said blade assembly and a second end mounted on said lower surface of said support plate.

10. Apparatus as set forth in claim 9 including means for providing vertical movement to said ballast plow assemblies.

11. Apparatus as set forth in claim 10 wherein said means for providing vertical movement to said plow assemblies is a slider box assembly, said slider box assembly having an inner shaft mounted for sliding movement in an outer hollow shaft, said outer shaft being secured to said machine and said inner shaft being secured to said tie plow assembly, and fluid actuator means including a cylinder, piston, and piston rod, said cylinder being pivotally connected to said outer hollow shaft and said piston rod being connected to said support plate of said tie plow.

12. Apparatus as set forth in claim 10 wherein means for providing vertical movement to said plow assemblies include a four-bar parallel linkage assembly, said linkage assembly comprising a first frame connected to said plow assembly and a second frame connected to said machine, said first and second frames being pivotally connected together by first and second pairs of parallel linkage members, each said linkage member having distal ends which are respectively pivotally secured to said first and second frames, and fluid actuator means disposed for relative pivotal movement of said first and second frames wherein said tie plow is raised or lowered.

* * * * *